United States Patent [19]

Coffey

[11] 4,048,692

[45] Sept. 20, 1977

[54] COMBINED DUST PAN AND BROOM HOLDER

[76] Inventor: D. A. Coffey, 13613 Occidental Ave. South, Seattle, Wash. 98168

[21] Appl. No.: 716,759

[22] Filed: Aug. 23, 1976

[51] Int. Cl.[2] ..... A47L 13/52

[52] U.S. Cl. ..... 15/257.2

[58] Field of Search ..... 15/257.2, 257.1, 105, 15/111

[56] References Cited

U.S. PATENT DOCUMENTS

| | | | |
|---|---|---|---|
| 853,486 | 5/1907 | Tungate | 15/257.1 |
| 1,466,454 | 8/1923 | Mock | 15/257.2 |
| 3,082,455 | 3/1963 | Evoncha | 15/257.2 X |

FOREIGN PATENT DOCUMENTS

| | | | |
|---|---|---|---|
| 389,844 | 7/1965 | Switzerland | 15/257.1 |

*Primary Examiner*—Edward J. McCarthy
*Attorney, Agent, or Firm*—Mark C. Jacobs

[57] ABSTRACT

A novel dust pan is provided having flexible partially secured top wall, foldable handle means and a crosswire retainer means, wherein a broom is intended to be stored in said dust pan when both are not in use against the wall, the handles of said pan resting on the floor.

8 Claims, 8 Drawing Figures

COMBINED DUST PAN AND BROOM HOLDER

BACKGROUND OF THE INVENTION

Ever since the days of the thirteen American colonies, people have been using brooms and dustpans as part of their household equipment for cleaning floors, walks and porches here in the United States. As a consequence of the drudgery and cleaning and the inconvenience of storage of the broom separate from the dustpan, men and women have been searching for combined storage capability. This is shown through the history of the patent literature.

One early U.S. Pat. No. is that to Nash, 345,069 issued in 1886. Another is the patent of Bishop issued in 1892 and bearing U.S. Pat. No. 468,433. That patent employs a special clip mechanism for latching the broom to the dustpan.

Ormsby, U.S. Pat. No. 691,965 is an early model dustpan, in that the dust can emerge from the rear side of the pan as it is all open in the rear, there being no rear wall.

The Gross and Peterson which is intended for wall storage has a pair of wing members for enclosing the broom, U.S. Pat. No. 742,859;1903.

One other patent of which I am familiar is that of Curran U.S. Pat. No. 1,659,461, which is also open at the rear, and which invention employs a foot plate which when engaged forces a plate downwardly. The invention pertains primarily to the operation of the dustpan.

It is worthy of note that none of these patents employs the spatial relationship of broom to pan as I do. None of these, when in the storage position are intended for the handle to be up in the air on the broom, with the tips of the bristles pointed downwardly, and nesting into the narrowing or converging side walls of the pan, with the front part of the pan when stowed, facing upward and the back side and handles resting of the ground.

It is an object therefore to provide a new improved dustpan which resembles the conventional type we are familiar with today, but which has many novel features, is easy to use and is comparatively easy to manufacture.

It is one object of this invention to provide an improved dustpan which will lay flat against the wall when not in use.

It is another object to provide a dustpan which when stored, will not drop excess dirt on the floor of the storage zone.

It is yet another object to provide a dust pan which can easily cooperate with a standard broom for their combined storage.

It is a further object to provide a dust pan with an openable top portion, but which can be maintained in a secured position when desired and which prevents broom configuration distortion.

It is a yet further object to provide a new dust pan with a handle portion that rotates for easy storage.

These and other objects of the invention will become apparent upon a review of this specification in light of the accompanying drawings.

SUMMARY OF THE INVENTION

Briefly stated, the instant invention is a new dustpan having an openable top wall, for easy placement and removal of a broom which is intended to be stored therewith. While said top is openable, there is a crosswire retainer for securing the top portion in a closed position, and also the member serves the dual function of helping to support the stored broom in the dustpan. The novel pan of this invention features, pivotable handles that orient from a stowable position to a grippable position for use. In another embodiment, the handles comprise a plurality of rectangular members that fold over each other forming a collapsed structure for storage and an elongated handle for gripping and use.

In both embodiments the crosswire retainer can be relocated at its securing end to ease the operation of the pan such as to resemble those of the prior art in operation.

The overall pan possesses upwardly and slightly outwardly bent side walls which serve to prevent the sweepings from falling over or out the sides of the receptacle and these side walls also act as a retaining means for the broom when same is stored in the pan. The pan tapers rearwardly and terminates in an upstanding rear ward that joins with the pair of upstanding side walls. A top wall openable at one side is secured to one of said upstanding side walls.

DESCRIPTION OF THE DRAWINGS

It is to be seen that in the following drawings, reference numbers that are alike, refer to like parts of several Figures.

DESCRIPTION OF THE PREFERRED EMBODIMENT

Figure 1:
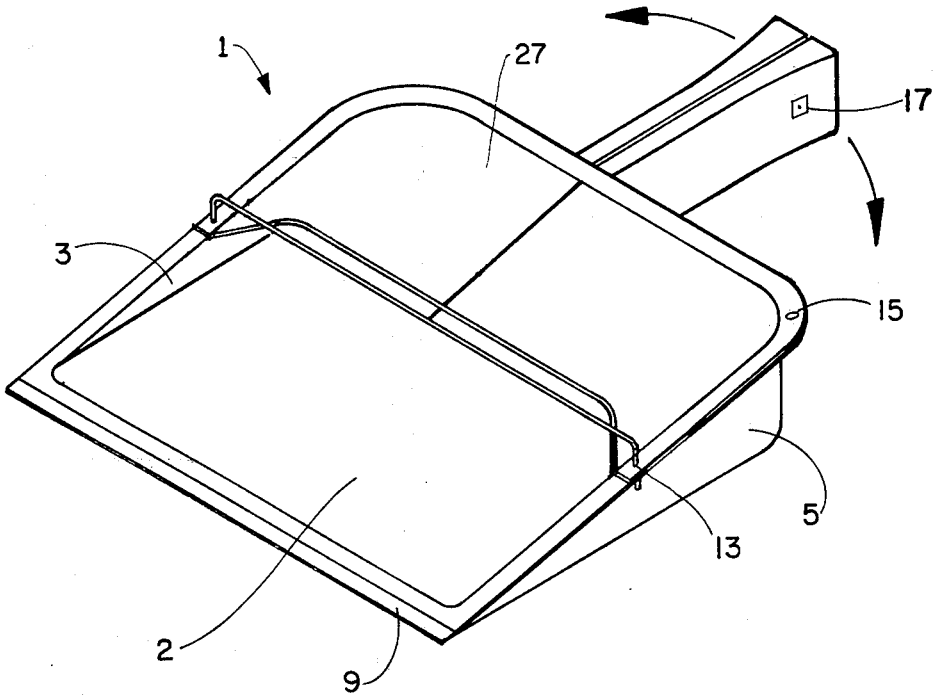
FIG. 1 is a perspective view of the dust pan of this invention, showing the handles folded in the open position for the gripping of same and showing the crosswire retainer band in place.

In FIG. 1 there is is shown a dust pan 1; which comprises several sections, a flat body portion 2 having up raised side walls 3,5, which slope outwardly from the base of said pan. The side walls preferably formed integral with the body portion as by bending the material employed to the degree desired, if metal, or by using a one piece mould, if the unit is to be made of plastic. These side walls act to prevent the sweepings from falling over the sides of the body portion. The body of the receptacle 1 and the side walls 3,5, are tapered from the front to rear in order that there be adequate room for the insertion of the head of a broom with ease, while still not permitting the bristle ends to become bent out of shape rendering the broom useless if they were permitted to contact a portion of the pan on a continuous basis during non-use.

An interval to the body 2 and the side walls 3,5, rear wall is provided, and designated 7. A rubber lip 9, similar to those of the prior art is disposed along the flat leading edge of the body portion 2.

Top panel 27, is partially secured to the pan, by being fixed to one side of said side walls 3 or 5 and to a portion of said rear wall 7. Top panel 27 has a flat portion of suitable configuration, having a centre section and preferably a pair of forward protruding side sections. Top panel 27 is disposed in a plane parallel to the body portion 2 or substantially parallel thereto. Each of said side sections have a terminal portion disposed angularly downward. One of said side sections is secured to its corresponding side's upstanding side wall 3 or 5. It is understood that either of the side sections of the top panel may be so secured, as by screws, rivets or the like.

The segment of top panel 27 that is secured to the rear wall 7 is secured at the proximal end of said panel to rear wall 7. This attachment may be by welding, glueing, interlocking tabs or any means known to the art, and forms no part of this invention. The secured segment attached to rear wall 7, should constitute at least one-third and preferably one-half of the total width across the top panel 27 in order to provide sufficient dimensional stability to the top panel such that it will not fall forward and thus block the positioning of a broom there in the cavity formed by the top panel the upraised side walls and the body portion, namely members 2,3,5 and 27. Top panel 27 should extend forward from the rear wall 7 at least about one-third of the distance from the rear wall 7 to the rubber lip 9 constituting the length dimension of the body portion 2.

The balance of the width of the top panel 27 is neither secured to the rear wall 7 or to the second mentioned side wall. At the termination of the secured portion attached to the rear wall 7, and running forwardly at right angles to the rear wall there is provided a flexing means for the unsecured portion of the top panel 27. This may be in the form of scoring of the metal or plastic being employed for said top panel; or optionally if so desired the unsecured portion of 27 may be a totally separate member attached by a hinge (not shown) to the secured portion of 27. Said hinge would constitute such a flexing means. Said unsecured portion 27B, would rotate upwardly and would be so moved for easy enplacement of the broom. When said broom has been placed in the device for storage, said unsecured portion 27*b* is placed in a plane the same as that of 27*A;* whereby the downwardly disposed terminal portion is removably engaged with the corresponding upstanding side wall by overlapping same on its external side, the spacing between the downwardly disposed portion of the top panel 27 and the upraised side wall being minimal such that a friction fit occurs.

A crosswire retainer 11 is provided to help engage and hold the broom in the device 1. This crosswire retainer is secured in a rotatable manner on one side to the top panel at the forward end thereof, near its junction with a side wall 3 or 5. The crosswire 11 has a generally inverted U-shape configuration with a catch like protrusion at the free end of each leg of the U for engagement with top panel 27, in a removeable manner on one side thereof and rotatably and orientably on the other side thereof.

There are provided on the opposite side of top panel 27 from which one leg of cross wire 11 is attached, two apertures, 13 a forwardly positioned aperture and 15 the rearwardly positioned aperture. Forward aperture 13 is positioned in top panel 27 a distance from the rear wall 7 equal to that of the attaching point of the secured leg of the crosswire and equidistant from the side wall as is the point of attachment from its corresponding side wall. The rearwardly positioned aperture 15 is located at approximately the junction point of the rear wall 7 with the unsecured portion of the top panel 27 and the corresponding side wall, at a distance from the attaching point of the secured U leg equal to that of the forwardly positioned aperture, such that the retainer 11 can be inserted therein, during useage of the device for dust and dirt collection.

The apertures in the lip of side wall 5 that correspond to 13 and 15 of top panel 27 are 14 and 16. Apertures 14 and 16 are aligned with apertures 13 and 15 when panel 27B is in contact with the lip of side panel 5.

When the retainer 11 is inserted at its free end in aperture 15, the downward force of the leg helps to retain the friction engagement of the top panel 27 with side wall 3 or 5 as the case may be.

Figure 2:
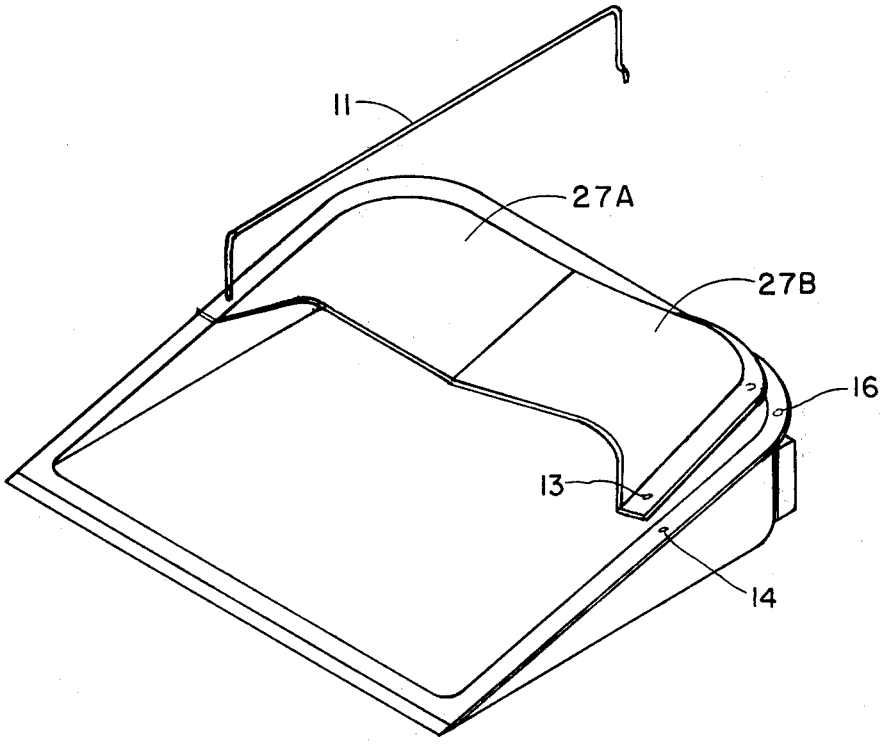
FIG. 2 is a perspective view of the instant device, which shows the handles folded closed and the crosswire retainer unlatched, and further showing the top of the pan in open raised away spatial relationship.

When placed in the front positioned aperture, the retainer 11 aids in holding the broom in place during storage. It is understood that the movement of the free leg of retainer 11 from aperture to aperture is not required, but can be beneficial in ease of operation. Reference is best had to FIG. 2 which illustrates the relative location of the two apertures and free orientation of the secured leg of the crosswire retainer 11, and also the flexible location of one portion of top panel 27.

Figure 3:
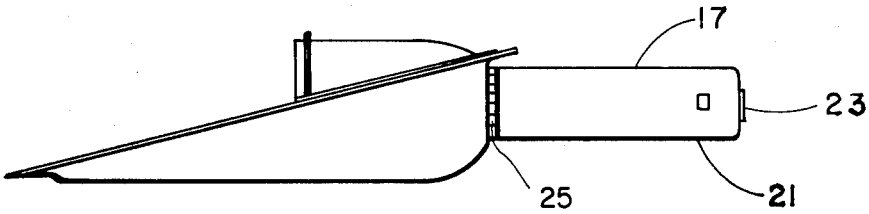
FIG. 3 is a side elevational view of the instant device showing the handles folded open and the securing latch for same in place.
Figure 4:
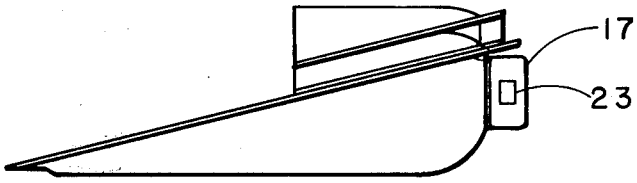
FIG. 4 is a side elevational view showing the handles folded closed, as for storage, and the top of the pan open.

Turning now to side elevations FIGS. 3 and 4 there is seen one of a pair of handles, 17, secured hingedly to rear wall 7 by hinge means 25. Handle 19 not shown is secured by hinge 26 which orients 90° rightwardly, while that hinge shown, 25 orients 90° leftwardly.

In FIG. 3, the two handles are seen to be in the open or grippable operating position, though only one is shown, namely 17, while in FIG. 4, it is shown in the stowed, closed position for storage. Also seen in both figures are the hasp 23 used to detachably secure one handle to the other during operational use.

Snaps 21 and 22, not shown, are used to secure each handle to the rear wall during the time of storage. One half of each snap means is located on the handle at a suitable location while the other half is attached in a suitable manner to rear wall 7 such that on orientation of the handle toward the rear wall 7 the two portions of the snap will engage as is known in the art. While the snaps are not required, they are shown for the preferred embodiment. Any suitable snap including a Velcro® strip can be employed, for adhering removeable the handles to the rear wall.

Figure 6:
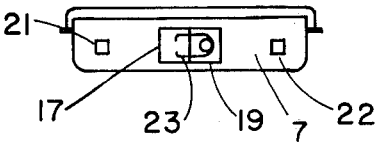
FIG. 6 is a rear elevated view of another embodiment of this invention depicting a foldable handle means.

FIG. 6 is a rear elevational view showing the handles 17, 19 secured by hasp 23 in the gripping operational position, wherein the hasp is shown in detail.

It is seen that in the embodiment of FIG. 3, that the two handles are adapted to orient in opposite 90° arcs such that when oriented inwardly they are disposed parallel to the rear wall, and when outwardly, they are disposed parallel to each other and at right angles to the rear wall.

Figure 5:
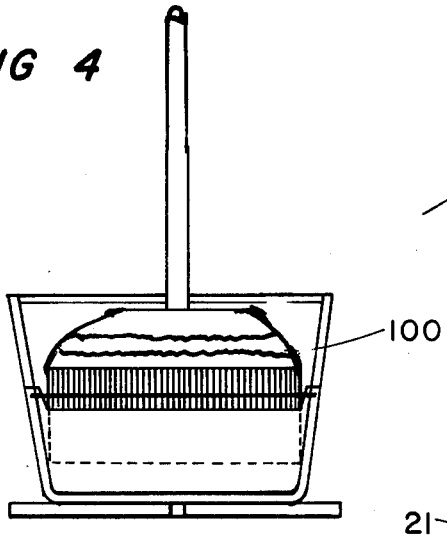
FIG. 5 is a top elevational view which shows the instant device being employed with a broom inserted therein, the handles folded shut and the device abutted against the wall at the wall's junction with the floor.

FIG. 5 depicts a top elevational view showing the handles 17, and in 19 in a stowed position, crosswire 11 engaged in forward aperture 13, and the broom 100 held in place uprightwardly by both top panel 27 and the crosswire retainer.

Figure 7:
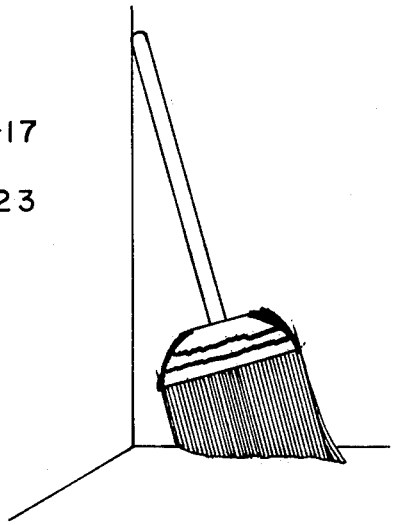
FIG. 7 is a view of a broom whose configuration has been distorted due to it having been placed in a leaning position against a wall for storage, a phenomenon prevented by the use of the instant device for broom storage.

FIG. 7 depicts a broom wherein successive bristles lay over, flattened out to form a point on one end of the broom, such that it becomes distorted, and almost impossible to use. Such distortion is avoided by using the device of the instant invention since the bristles never rest on the floor during periods of nonuse of the broom.

Figure 8:
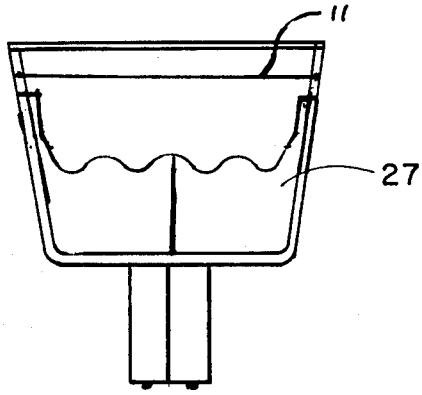
FIG. 8 is a top plan view of an alternate embodiment of the instant invention.

FIG. 8 illustrates an alternate embodiment wherein the top portion 27 is shown to be of a different configuration. In this embodiment the crosswire is shown to be forward of the top member both as to the hinge point and its terminal point. The handles are shown in a closed position for operation. This embodiment further serves to illustrate the non-criticality of the front portion of top panel 27's configuration.

OPERATION AND COOPERATION

The device of this invention is utilized in like manner as any prior art dustpan. The use thereof is so well known that details need not be recited herein. The dust and dirt entrapped in the pan is released frontwardly, by merely tipping the dust pan such that the particulates can be disposed of. It is recommended however, though not required, that the crosswire retainer be placed at position 15, for operation of the pan, as it will be easier to push the dust into the depths of the pan rearwardly of the leading edge of top member 27, in the vicinity of the rear wall 7's, inside surface.

After the owner of the device is through using same as a dust pan, the dirt therefrom is emptied, the handles 17, 19 are unsecured from each other; after being oriented about 90°, they are each secured to rear wall 7, as by snaps. The crosswire retainer's engaging portion is repositioned to position 13, in order to help support the broom, and the broom is inserted into said pan, the unbound widest portion furthest away from the handle entering first. The device with the broom therein is now placed on the floor up against the wall as a combined entity, after the openable top panel 27 is secured in place, as is shown in FIG. 5.

When placed in a cooperating relationship, for storage, it is seen that excess dust and dirt is prevented from falling on the floor as the open end of the pan 1 is always stored facing upward. Also dust and dirt clinging to the broom is prevented from re-entering the room, as the unbound end of the broom is secured inside the pan. The pan handles, when opened up into the storage position as in the first embodiment, and when closed up as in the second embodiment, form a stable base upon which the pan can rest vertically. Which fact prevents the broom from falling as the unbound bristles are not very sturdy and as such the broom would normally tip over, but for being stored in the dust pan.

In recapitulation, it is seen that there has been provided a novel dustpan which can be utilized like a conventional dust pan but which can be employed also for the storage of the broom therein. This pan allows the householder to store both the broom off the floor, as it is held in wedged confinement in the pan, thereby preserving the bristle ends as they touch nothing, at rest, and also the pan off the floor vertically such that any residual dust and dirt is kept confined in the pan, be the dirt loose in the pan or adhered to the broom. The unique crosswire retainer helps to secure the confinement of the broom in the pan during storage, while the flexible top panel by being openable allows for easy entry for the broom at the desired time of stowage, yet by being held in frictional alignment with the side wall, it retains the broom in the pan.

While in the embodiments described above, crosswire has been indicated to be a wire member, configured as shown in the appropriate figures, it is to be seen that a flat plate-like member with suitable engaging means can also be employed as the crosswire retainer 11, to retain the broom in place during storage. Such a flat plate, of metal or plastic is pivotably mounted on one side of same to said top panel, and has an aperture engaging means on the opposite end thereof.

Thus it is to be seen that my invention serves double duty. It acts as a retainer means for the broom when the broom is to be stored in the dustpan and also prevents damage to the end of the broom bristles.

The invention may also be embodied in other specific forms without departing from its spirit or essential characteristics. The present embodiments are, therefore, to be considered in all respects as illustrative only and not restrictive, the scope of the invention being indicated by the claims rather than by the foregoing description, and all changes which come within the meaning and range of equivalents of the claims are therefore intended to be embraced therein.

What is claimed is:

1. A claimed dust pan and broom holder comprising a receptacle having a pan portion with upwardly and outwardly sloping side walls, and an upstanding rear wall connected to said side walls; a top panel flexible along an axis from front to back and secured in part to said pan portion, disposed in a plane generally parallel to the pan, said top panel terminating its non-secured portion in a terminal portion removably engageable with one of said upstanding side walls of the pan to form an enclosure which is open at the front;

b. a crosswire retainer rotatably secured on one end at the forward end of one side of said top panel, the other end thereof being engageable with either of a pair of apertures on the other side of said top panel, moveable;

c. a handle means movable from a stowable to a grippable position, secured to the external side of said rear wall of said pan and adopted such that the receptacle can be stored in a vertical position resting on said handle means when said handle means is in the stowable position.

2. The combined dust pan and broom holder of claim 1, wherein the flex means of said top panel comprises a score in said panel's upper surface.

3. The combined dust pan and broom holder of claim 1, wherein said handle means cmprises a pair of handles each hingedly secured to the rear wall and adapted to orient in opposite 90° arcs whereby when oriented inwardly they are disposed parallel to said rear wall, and when oriented outwardly they are disposed at right angles to the rear wall and parallel to each other.

4. The combined dust pan and broom holder of claim 1, wherein said handle means comprises plurality of equi-dimensional members rotatably inter-connected to each other; one of which is connected to the rear wall of said pan, and adapted to unfold into a grippable position, and to fold to a stowable position.

5. The combined dust pan and broom holder of claim 1, wherein the top panel comprises a central segment, and two forwardly protruding side segments, one of which is secured to said pan, the other of which is releaseably engageable with one of said upstanding side walls.

6. The combined dust pan and broom holder of claim 1, wherein one of said apertures is in one forwardly protruding unsecured segment of said top panel, and the other aperture is in the rear part of said top panel unsecured segment.

7. The combined dust pan and broom holder of claim 1, wherein the crosswire retainer is a flat plate pivotably mounted on side thereof and having an aperture engaging means on the opposite end thereof.

8. The combined dust pan and broom holder of claim 1 wherein the crosswire retainer is positioned forward of the top portion and its hinge point.

* * * * *